US012258107B2

(12) United States Patent
Takano et al.

(10) Patent No.: US 12,258,107 B2
(45) Date of Patent: Mar. 25, 2025

(54) OVERBOARD DETECTION SYSTEM, AND WATERCRAFT INCLUDING THE OVERBOARD DETECTION SYSTEM

(71) Applicant: YAMAHA HATSUDOKI KABUSHIKI KAISHA, Iwata (JP)

(72) Inventors: Naoju Takano, Shizuoka (JP); Makoto Ito, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 80 days.

(21) Appl. No.: 18/120,450

(22) Filed: Mar. 13, 2023

(65) Prior Publication Data

US 2023/0294804 A1 Sep. 21, 2023

(30) Foreign Application Priority Data

Mar. 15, 2022 (JP) ..... 2022-040092

(51) Int. Cl.

| | |
|---|---|
| ***B63C 9/00*** | (2006.01) |
| ***B63B 21/24*** | (2006.01) |
| ***B63B 45/02*** | (2006.01) |
| ***B63B 45/08*** | (2006.01) |
| ***B63B 79/40*** | (2020.01) |
| ***B63H 21/21*** | (2006.01) |

(52) U.S. Cl.

CPC ..... *B63C 9/0005* (2013.01)

(58) Field of Classification Search

CPC ..... B63B 79/40

See application file for complete search history.

(56) References Cited

U.S. PATENT DOCUMENTS

| | | | | |
|---|---|---|---|---|
| 6,150,928 | A * | 11/2000 | Murray | B63J 99/00 340/984 |
| 2004/0113836 | A1* | 6/2004 | Rickerson, Jr. | B63C 9/11 342/357.54 |
| 2005/0040987 | A1* | 2/2005 | Bruno | G01S 5/0231 342/357.31 |
| 2008/0174484 | A1* | 7/2008 | Katz | G08B 21/0288 342/417 |
| 2018/0043977 | A1* | 2/2018 | Assal | G06V 40/23 |
| 2020/0255104 | A1* | 8/2020 | Gonring | B63H 21/21 |
| 2022/0038190 | A1* | 2/2022 | Jackson | H04L 69/18 |

* cited by examiner

*Primary Examiner* — Joseph H Feild
*Assistant Examiner* — Pameshanand Mahase
(74) *Attorney, Agent, or Firm* — Keating & Bennett, LLP

(57) ABSTRACT

An overboard detection system includes a fob to be carried by a user on a watercraft, an overboard sensor to detect a user overboard event when the user carrying the fob falls overboard, and a communicator on the watercraft to wirelessly communicate with the fob and to transmit a rescue intention notification indicating a rescue intention to the fob carried by the user involved in the overboard event. The fob includes a transmitter operable to provide the rescue intention notification to the overboard user upon reception of the rescue intention notification.

9 Claims, 5 Drawing Sheets

F

OVERBOARD DETECTION SYSTEM, AND WATERCRAFT INCLUDING THE OVERBOARD DETECTION SYSTEM

CROSS REFERENCE TO RELATED APPLICATIONS

This application claims the benefit of priority to Japanese Patent Application No. 2022-040092 filed on Mar. 15, 2022. The entire contents of this application are hereby incorporated herein by reference.

BACKGROUND OF THE INVENTION

1. Field of the Invention

The present invention relates to an overboard detection system and a watercraft including the overboard detection system.

2. Description of the Related Art

US 2020/0255104A1 discloses a wireless lanyard system that detects a person falling overboard from a watercraft by utilizing wireless communications between a transceiver provided in a helm area of the watercraft and a fob carried by the person. Such an overboard event is detected when the fob does not return a response signal in response to a query signal periodically transmitted by the transceiver, and an alarm is issued.

SUMMARY OF THE INVENTION

The inventors of preferred embodiments of the present invention described and claimed in the present application conducted an extensive study and research regarding an overboard detection system, such as the one described above, and in doing so, discovered and first recognized new unique challenges and previously unrecognized possibilities for improvements as described in greater detail below.

When an overboard event occurs, an occupant on the watercraft searches for and rescues the person who has fallen overboard from the watercraft. The overboard person may feel relieved if he or she is able to know how the rescue operation is proceeding. If the overboard person is far away from the watercraft, however, the user is not able to visually check the state of the rescue operation.

Preferred embodiments of the present invention provide overboard detection systems that each enable an overboard person to easily check the state of the rescue operation, and watercraft including the overboard detection systems.

In order to overcome the previously unrecognized and unsolved challenges described above, a preferred embodiment of the present invention provides an overboard detection system including a fob to be carried by a user on a watercraft, an overboard sensor to detect a user overboard event when the user carrying the fob falls overboard, and a communicator on the watercraft to wirelessly communicate with the fob and to transmit a rescue intention notification indicating a rescue intention to the fob carried by the user involved in the overboard event. The fob includes a transmitter to provide the rescue intention notification to the overboard user upon reception of the rescue intention notification.

With this arrangement, the rescue intention notification is able to be transmitted from the communicator provided on the watercraft to the fob carried by the overboard user, and the fob provides the rescue intention notification to the overboard user upon the reception of the rescue intention notification. Thus, the rescue intention is provided to the overboard user. Therefore, the overboard user is able to easily know the state of a rescue operation.

In a preferred embodiment of the present invention, the overboard detection system further includes an input on the watercraft and operable by the user. If a rescue intention notification command is inputted from the input, the communicator transmits the rescue intention notification to the fob carried by the user involved in the overboard event.

With this arrangement, the rescue intention notification is able to be transmitted to the fob carried by the overboard user by operating the input provided on the watercraft. Thus, an onboard user is able to provide the rescue intention notification to the overboard user. Therefore, the overboard user is able to know the state of the rescue operation.

In a preferred embodiment of the present invention, the fob includes an input operable by the user. If the rescue intention notification command is inputted from the input by a fob carried by the onboard user, the communicator is operable to transmit the rescue intention notification to the fob carried by the user involved in the overboard event.

With this arrangement, the rescue intention notification is able to be transmitted to the fob carried by the overboard user by operating the input of the fob carried by the onboard user. Thus, the onboard user is able to transmit the rescue intention notification to the overboard user. Therefore, the overboard user is able to know the state of the rescue operation. In addition, the onboard user is able to promptly provide the rescue intention notification by operating the input of the fob carried by onboard user.

In a preferred embodiment of the present invention, the transmitter is operable to generate at least one of sound, light, or vibration to provide the rescue intention notification to the overboard user. With this arrangement, the overboard user is able to easily check the rescue intention by the sound, the light, or the vibration.

In a preferred embodiment of the present invention, the fob includes a microphone and a speaker to provide a speech communication function to transmit and receive voice signals through wireless communications with the communicator. With this arrangement, the overboard user is able to perform speech communications with the use of the fob. As a result, the overboard user is able to easily check the state of the rescue operation and report his or her current situation through conversation.

In a preferred embodiment of the present invention, the communicator relays inter-fob speech communications between the fob and another fob carried by another user on the watercraft. With this arrangement, speech communications are able to be performed between the fob of the overboard user and the fob carried by any other onboard user so that the overboard user is able to easily check the state of the rescue operation and report his or her current situation through conversation.

In a preferred embodiment of the present invention, the communicator is operable to transmit and receive voice signals through wireless communications with a mobile phone so as to relay fob/mobile phone speech communications between the fob and the mobile phone. With this arrangement, speech communications are able to be performed between the fob of the overboard user and the mobile phone, so that the overboard user is able to easily check the state of the rescue operation and report his or her current situation through conversation. Since the speech communication with the mobile phone is possible, the speech communication partner is not limited to the onboard users. Therefore, the overboard user is able to more easily check the state of the rescue operation.

In a preferred embodiment of the present invention, the overboard detection system further includes a fixed speech communicator on the watercraft and including a microphone and a speaker. The communicator relays speech communications between the fixed speech communicator and the fob. With this arrangement, speech communications are able to be performed between the fixed speech communicator provided on the watercraft and the fob of the overboard user, so that the overboard user is able to easily check the state of the rescue operation, and report his or her current situation through conversation.

In a preferred embodiment of the present invention, the overboard sensor includes a periodic signal receiver to receive a periodic signal periodically generated by the fob, and to detect the user overboard event based on the reception state of the periodic signal received by the periodic signal receiver. The overboard sensor may periodically transmit a query signal to the fob, and the fob may transmit a response signal in response to the query signal. In this case, the response signal transmitted by the fob is an example of the periodic signal periodically generated.

Another preferred embodiment of the present invention provides a watercraft including a hull, and the overboard detection system including any of the above-described features.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
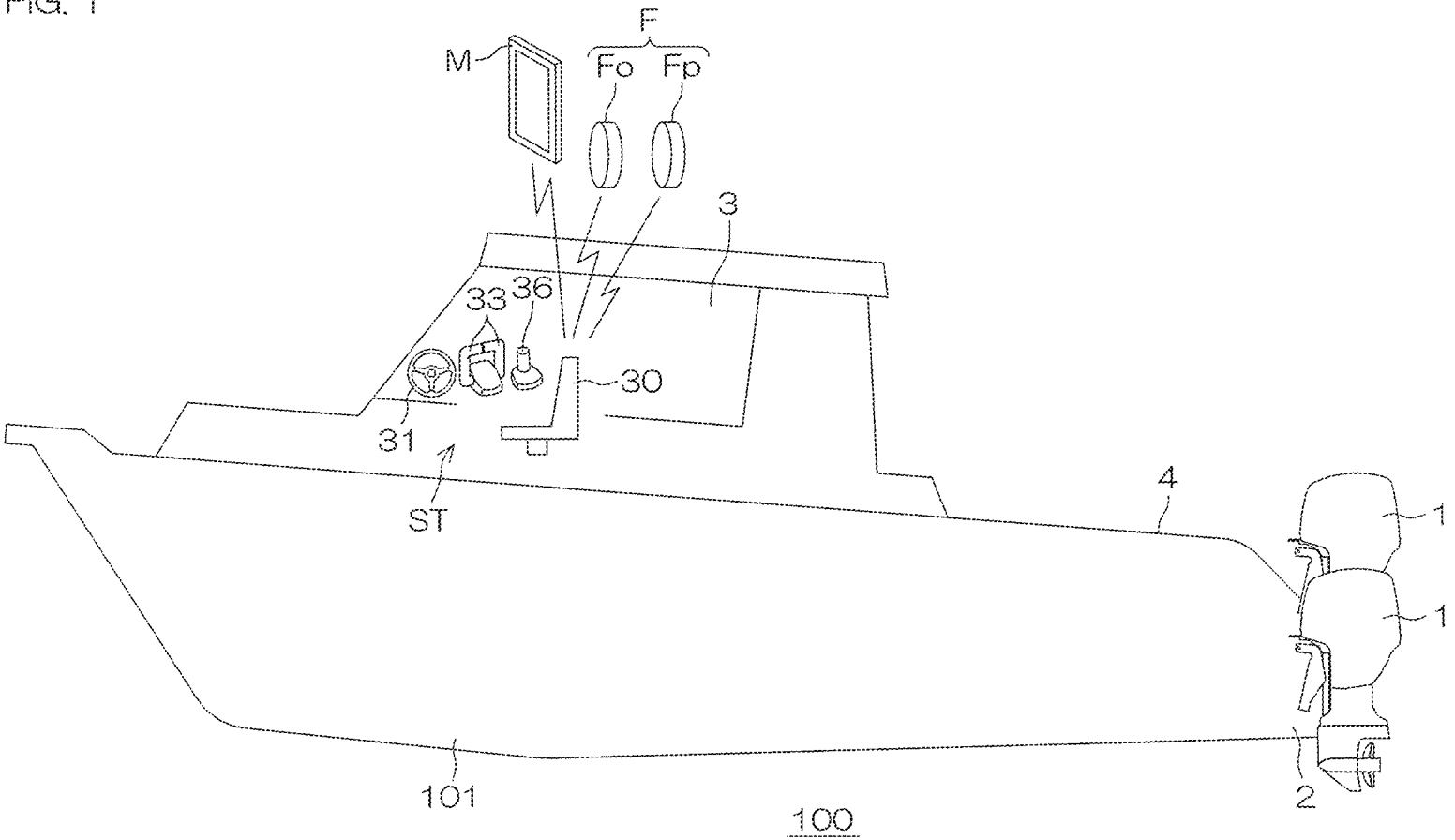
FIG. 1 is a diagram showing the structure of a watercraft according to a preferred embodiment of the present invention by way of example.

FIG. 1 is a diagram showing the structure of a watercraft 100 according to a preferred embodiment of the present invention by way of example. The watercraft 100 includes a hull 101 and outboard motors 1 provided as exemplary propulsion systems on the hull 101. In this example, two outboard motors 1 are attached to the stern 2 of the hull 101, and arranged side by side transversely of the hull 101.

The hull 101 includes a cabin 3 defined by an outer shell to provide a living space, and a deck 4 provided behind the cabin 3. The watercraft 100 includes a watercraft maneuvering station ST (watercraft maneuvering area). In FIG. 1, the watercraft 100 is illustrated as including a single watercraft maneuvering station ST provided in the cabin 3 by way of example. Alternatively, the watercraft 100 may include a plurality of watercraft maneuvering stations provided on the hull 101.

In the present preferred embodiment, a steering wheel 31, acceleration levers 33, and a joystick 36 are provided in the watercraft maneuvering station ST. The steering wheel 31 is operable to steer the watercraft 100, and the acceleration levers 33 are operable to adjust the propulsive force. The joystick 36 is operable to steer the watercraft 100 and to adjust the propulsive force. A watercraft maneuvering operation is generally performed by operating the steering wheel 31 and the acceleration levers 33. The joystick 36 is mainly used for the watercraft maneuvering operation when the azimuth and/or the position of the watercraft 100 are finely adjusted during docking and undocking, and during berthing at a fishing spot. Of course, the watercraft maneuvering operation with the use of the joystick 36 is not limited to that for the adjustment of the azimuth and/or the position of the watercraft 100 during low-speed traveling, and the joystick 36 may be used for the watercraft maneuvering operation during intermediate-speed and high-speed cruising.

The watercraft maneuvering station ST is an area (i.e., a watercraft maneuvering area) in which a watercraft operator performs the watercraft maneuvering operation. In the example of FIG. 1, the watercraft maneuvering station ST includes a driver seat 30 on which the operator sits. In some cases, no driver seat 30 may be provided in the watercraft maneuvering station ST.

Persons (occupants) who board the watercraft 100 may each carry a fob F. Typically, the fob F is carried on the occupant's body. The fob F may be wearable, for example, on a wrist, a neck, a belt, or clothing. The occupants are each categorized as the operator or a passenger. The operator fob Fo is carried by the operator and a passenger fob Fp is carried by a passenger. A reference character M denotes a mobile phone to be carried by any of the occupants.

Figure 2:
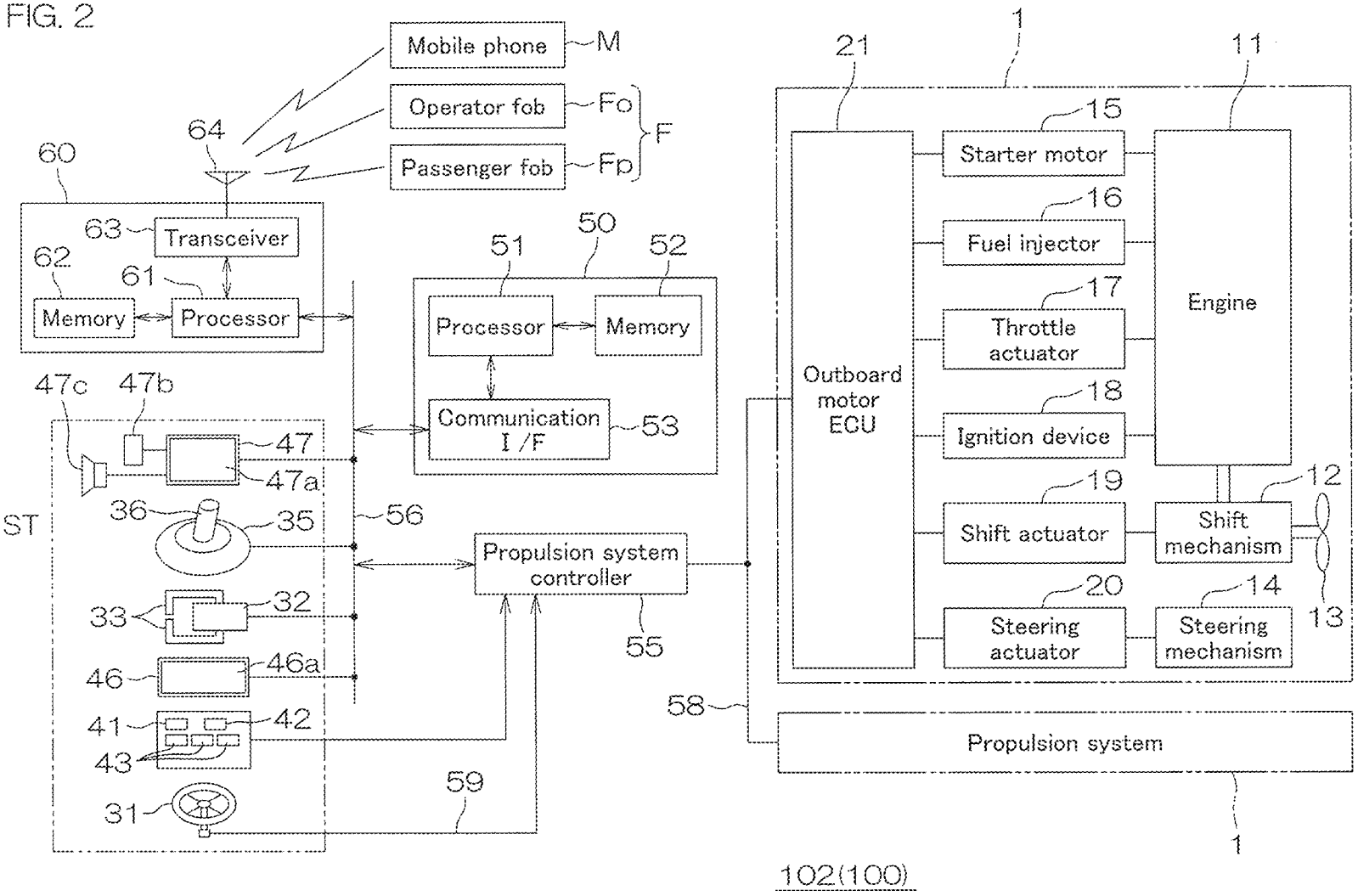
FIG. 2 is a block diagram showing the configuration of a watercraft maneuvering system by way of example.

FIG. 2 is a block diagram showing the configuration of a watercraft maneuvering system 102 provided in the watercraft 100 by way of example. The watercraft maneuvering system 102 includes the watercraft maneuvering station ST and the fobs F described above. In the present preferred embodiment, the watercraft maneuvering station ST includes the steering wheel 31, a remote control unit 32, and a joystick unit 35.

The remote control unit 32 includes two acceleration levers 33 respectively corresponding to the two outboard motors 1. The joystick unit 35 includes the joystick 36, which is able to be inclined anteroposteriorly and laterally (i.e., in all 360-degree directions), and is able to be turned (twisted) about its axis.

The watercraft maneuvering station ST additionally includes a main switch 41, an all-switch 42, separate switches 43, a gauge 46, a display 47 and the like. The main switch 41 is operable by the operator to turn on and off power supply to the watercraft maneuvering system 102. The all-switch 42 is operable by the operator to start or stop all the outboard motors 1. The separate switches 43 are operable by the operator to individually start or stop the respective outboard motors 1, and the number of the separate switches 43 corresponds to the number of the outboard motors 1. The gauge 46 is an instrument to display the operation states of the respective outboard motors 1. In the present preferred embodiment, the gauge 46 includes a touch panel **46*a* provided as an exemplary input device on its surface, thus serving as a man-machine interface. The display 47 displays various information. In the present preferred embodiment, the display 47 is a multifunctional display including a touch panel 47***a* provided as an exemplary input device on its surface, thus serving as a man-machine interface. In the present preferred embodiment, the display 47 further includes a microphone 47*b* and a speaker 47*c*, and is operable to provide a speech communication function with the use of the microphone 47*b* and the speaker 47*c*. That is, the display 47 functions as a fixed speech communication device provided on the watercraft 100.

The watercraft maneuvering system 102 includes a watercraft maneuvering controller 50 for overall system control, and a propulsion system controller 55 to generate command signals to be applied to the outboard motors 1. The watercraft maneuvering controller 50 and the propulsion system controller 55 are connected to each other via an onboard network 56 in a communicable manner. The onboard network 56 is typically a CAN (Control Area Network).

The remote control unit 32 and the joystick unit 35 are connected to the onboard network 56. The gauge 46 and the display 47 are also connected to the onboard network 56. The steering wheel 31 is connected to the propulsion system controller 55. Specifically, the operation angle signal of the steering wheel 31 is inputted to the propulsion system controller 55 via a steering signal line 59. Further, the main switch 41 is connected to the propulsion system controller 55 to input a power on/off command signal to the propulsion system controller 55. Further, the all-switch 42 and the separate switches 43 are connected to the propulsion system controller 55 to input a propulsion system starting command signal and/or a propulsion system stopping command signal to the propulsion system controller 55.

The propulsion system controller 55 is connected to outboard motor ECUs 21 as controllers of the respective outboard motors 1 (electronic control units, outboard motor controllers) via control signal lines 58. The propulsion system controller 55 transmits a steering command, a propulsive force command and the like to the outboard motors 1. In the present preferred embodiment, the propulsive force command includes a shift command to command the shift positions of the outboard motors 1, and an output command to command the outputs (the magnitudes of the propulsive forces) of the outboard motors 1. Further, the propulsion system controller 55 receives various detection signals from the outboard motor ECUs 21 of the respective outboard motors 1. The detection signals to be received may include signals indicating the states of the respective outboard motors 1, for example, shift position signals indicating the shift positions of the respective outboard motors 1, engine rotation speed signals indicating the engine rotation speeds of the respective outboard motors 1, and the like.

The outboard motors 1 may each be an engine outboard motor or an electric outboard motor. In FIG. 2, the engine outboard motors are shown by way of example. The outboard motors 1 each include the outboard motor ECU 21, an engine 11, a shift mechanism 12, a propeller 13, a steering mechanism 14 and the like. Power generated by the engine 11 is transmitted to the propeller 13 via the shift mechanism 12. The steering mechanism 14 laterally changes the direction of the propulsive force generated by the outboard motor 1 and turns the body of the outboard motor 1 leftward and rightward with respect to the hull 101 (see FIG. 1). The shift mechanism 12 selects the shift position from a forward shift position, a reverse shift position, and a neutral shift position. With the forward shift position selected, the propeller 13 is rotated in a forward rotation direction by the transmission of the rotation of the engine 11. With the reverse shift position selected, the propeller 13 is rotated in a reverse rotation direction by the transmission of the rotation of the engine 11. With the neutral shift position selected, the transmission of the power between the engine 11 and the propeller 13 is interrupted.

The outboard motors 1 each further include a starter motor 15, a fuel injector 16, a throttle actuator 17, an ignition device 18, a shift actuator 19, a steering actuator 20 and the like, which are controlled by the outboard motor ECU 21. The starter motor 15 is an electric motor which starts the engine 11. The fuel injector 16 injects a fuel to be combusted in the engine 11. The throttle actuator 17 is an electric actuator (typically including an electric motor) which actuates the throttle valve of the engine 11. The ignition device 18 ignites a mixed gas in the combustion chamber of the engine 11, and typically includes an ignition plug and an ignition coil. The shift actuator 19 is an actuator which actuates the shift mechanism 12. The steering actuator 20 is a drive source for the steering mechanism 14, and typically includes an electric motor. The steering actuator 20 may include a hydraulic device of an electric pump type.

The watercraft maneuvering controller 50 includes a processor 51 (arithmetic unit), a memory 52, a communication interface 53 and the like. The watercraft maneuvering controller 50 functions as various functional units by executing a program stored in the memory 52. Various data is stored in the memory 52. The onboard network 56 is connected to the communication interface 53. Thus, the watercraft maneuvering controller 50 is able to communicate with the propulsion system controller 55. Further, the watercraft maneuvering controller 50 is able to communicate with the remote control unit 32 and the joystick unit 35. The watercraft maneuvering controller 50 communicates with the gauge 46 via the onboard network 56 to receive an input signal from the touch panel 46*a* and to transmit display data to the gauge 46. Further, the watercraft maneuvering controller 50 communicates with the display 47 via the onboard network 56 to receive an input signal from the touch panel 47*a* and to transmit a display command signal to the display 47.

The watercraft maneuvering system 102 further includes a communication unit 60 which communicates with the fobs F. The communication unit 60 is connected to the watercraft maneuvering controller 50 via the onboard network 56. As described above, the fobs F may include the operator fob Fo to be carried by the operator, and the passenger fob Fp to be carried by the passenger. The communication unit 60 includes a processor 61, a memory 62, and a transceiver 63. For example, the communication unit 60 transmits a query signal to all the fobs F at a predetermined time interval (e.g., at an interval of 1 second). The fobs F respectively output response signals upon reception of the query signal. The response signals are received by the communication unit 60. The response signals outputted from the fobs F respectively include IDs (identification information) for identification of the fobs F. Thus, the communication unit 60 is able to identify the response signals outputted from the respective fobs F.

The IDs of the fobs F to be carried by the occupants are preliminarily registered in the memory 62 of the communication unit 60. The processor 61 of the communication unit 60 compares the IDs received from the respective fobs F by the transceiver 63 (hereinafter referred to as "reception IDs") with the IDs registered in the memory 62 (hereinafter referred to as "registration IDs"). Based on the results of the comparison, the processor 61 checks whether or not all the reception IDs corresponding to the registration IDs are received. Based on the check result, the processor 61 determines whether or not an overboard event has occurred. If any of the reception IDs corresponding to the registration IDs is absent, there is a possibility that the overboard event has occurred. Therefore, the processor 61 transmits overboard information indicating the occurrence of the overboard event to the watercraft maneuvering controller 50. The overboard information includes, for example, a registration ID corresponding to the absent reception ID. In the present preferred embodiment, the communication unit 60 thus functions as the overboard sensor. A reference character 64 denotes the antenna of the transceiver 63. The query signal is periodically outputted from the transceiver 63 of the communication unit 60, and the fobs F respectively output the response signals in response to the query signal. Therefore, the fobs F respectively periodically generate the response signals. The transceiver 63 which receives the response signals that are periodically generated (i.e., periodic signals) is an example of the periodic signal receiver.

Thus, the overboard detection system is fundamentally defined by the fobs F carried by the occupants, the functional portions of the communication unit 60 serving as the overboard sensor, and the other functional portions of the communication unit 60. That is, the watercraft maneuvering system 102 includes the overboard detection system in the present preferred embodiment. The watercraft 100 includes the hull 101 (see FIG. 1) and the overboard detection system.

In the present preferred embodiment, the communication unit 60 functions to relay communications between the fob F and the other fobs F, i.e., among the fobs F. The communications include voice signal communications in addition to data communications. That is, the communication unit 60 functions to relay voice speech communications (inter-fob speech communications) between the fob F and the other fobs F, i.e., among the fobs F.

The communication unit 60 further functions to relay communications between the display 47 and the fobs F. The communications include voice signal communications in addition to data communications. That is, the communication unit 60 functions to relay speech communications between the fobs F and the display 47 functioning as the fixed speech communication device.

The communication unit 60 further functions to relay communications between the mobile phone M and the fobs F. More specifically, the communication unit 60 functions to relay voice speech communications (fob/mobile phone speech communications) between the mobile phone M and the fobs F. The communication unit 60 may directly relay the voice speech communications between the mobile phone M carried by the occupant onboard and the fobs F, or may relay the voice speech communications between the fobs F and the mobile phone M via a base station of a mobile phone network.

Further, the communication unit 60 may function to relay voice speech communications between the mobile phone M and the display 47 serving as the fixed speech communication device.

The communication unit 60 further functions to transmit a rescue intention notification to a specific one of the fobs F carried by a person who has fallen overboard when an overboard event occurs. In the present preferred embodiment, more specifically, any of the occupants onboard is able to input a rescue intention notification command by operating the touch panel 46*a* of the gauge 46 or the touch panel 47*a* of the display 47. The rescue intention notification command is provided to the communication unit 60. If the rescue intention notification command is issued, the communication unit 60 identifies the specific fob F carried by the overboard person, and transmits the rescue intention notification to the fob F of the overboard person.

In a preferred embodiment, as will be described below, the fobs F each include an input device to be operated to input the rescue intention notification command. Any of the onboard occupants is able to input the rescue intention notification command by operating this input device. The rescue intention notification command is provided to the communication unit 60, which in turn transmits the rescue intention notification to the fob F of the overboard person.

Figure 3:
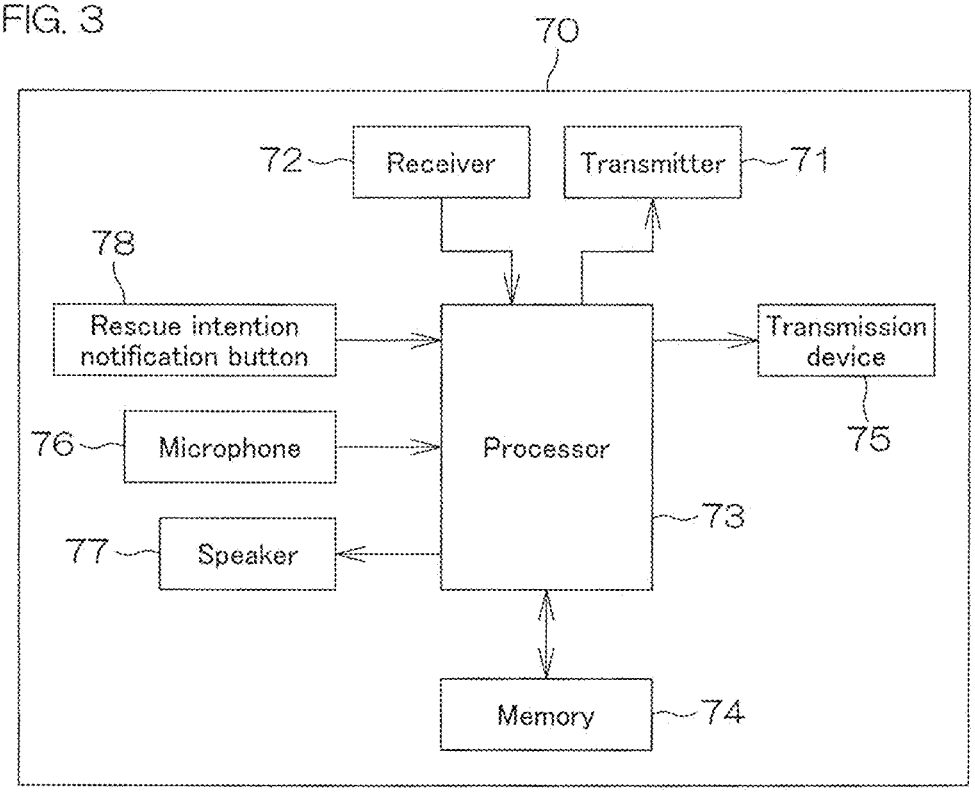
FIG. 3 is a block diagram showing the configuration of a fob by way of example.

FIG. 3 is a block diagram showing the configuration of the fob F by way of example. The fobs F each include a transmitter 71, a receiver 72, a processor 73, a memory 74, and a transmission device 75, which are accommodated in a portable water-proof housing 70. The fobs F each further include a microphone 76 and a speaker 77 to provide a speech communication function. The fobs F each further include a rescue intention notification button 78 as an input device to be operated by any of the occupants onboard so as to input the rescue intention notification command.

The processor 73 operates according to a program stored in the memory 74.

Specifically, the processor 73 operates to transmit the response signal from the transmitter 71 to the communication unit 60 when the receiver 72 receives the query signal from the communication unit 60 of the watercraft maneuvering system 102. The response signal is used for an overboard detection process to be performed by the communication unit 60. The response signal includes the ID of the fob F. The communication unit 60 provided on the watercraft 100 periodically generates the query signal, so that the transmitter 71 periodically generates the response signal.

If the receiver 72 receives the rescue intention notification from the communication unit 60 provided on the watercraft 100, the processor 73 actuates the transmission device 75 to provide the rescue intention notification to the overboard person.

The transmission device 75 provides the rescue intention notification to the overboard person by generating at least one of sound, light, or vibration. More specifically, the transmission device 75 is able to generate at least one of a buzzer sound, an audible message, display information, or vibrational information. Particularly, the vibrational information (vibration) is preferred because the vibrational information is less liable to be influenced by the ambient environment. Specifically, the vibrational information is highly effective even if noises such as wind sound, engine sound, and speaker sound make it difficult to deliver the audible information. Even if the influences of direct sun light and rain make it difficult to deliver the display information, the vibrational information is highly effective.

If the rescue intention notification button 78 is operated, the processor 73 transmits the rescue intention notification from the transmitter 71 to the communication unit 60.

The processor 73 is configured or programmed to perform the voice speech communication function if the receiver 72 receives voice speech communications from the communication unit 60. That is, voice signals received by the receiver 72 are made audible by the speaker 77. The processor 73 converts a voice sound inputted from the microphone 76 into voice signals, which are in turn transmitted from the transmitter 71 to the communication unit 60. Thus, voice speech communication relayed by the communication unit 60 is achieved.

Figure 4:
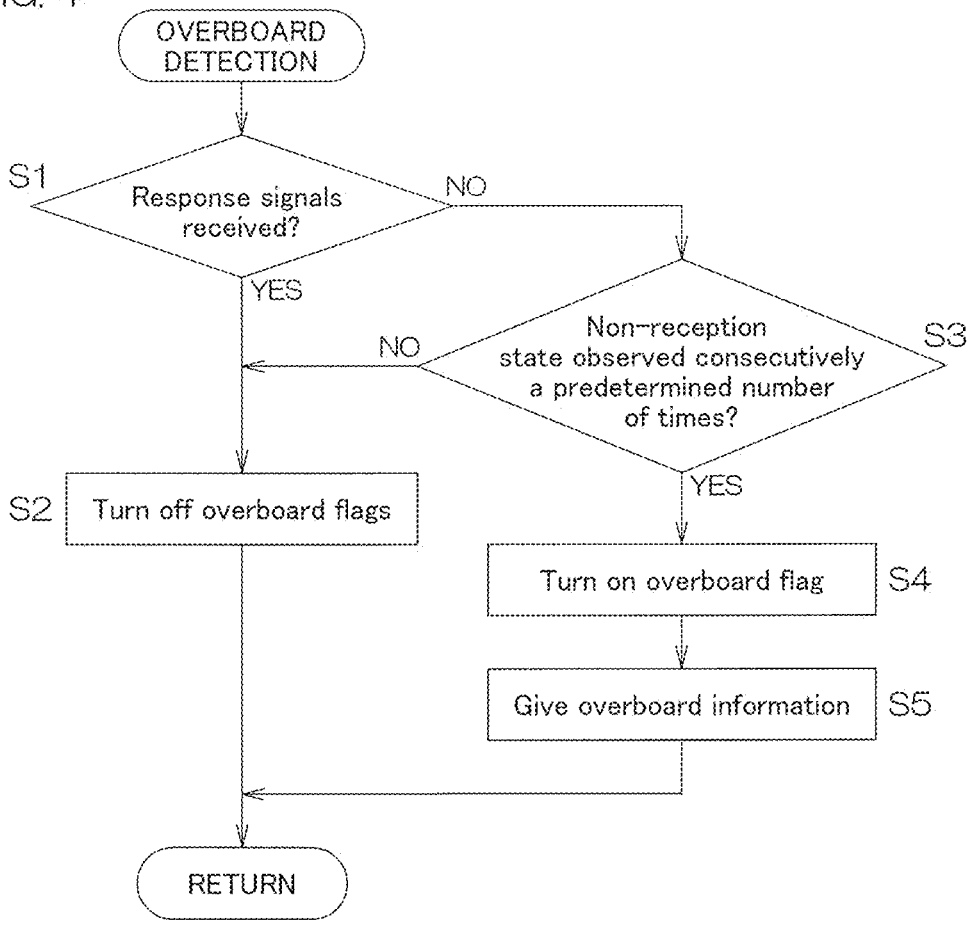
FIG. 4 is a flowchart showing an overboard detection function of a communication unit by way of example.

FIG. 4 is a flowchart showing the overboard detection function of the communication unit 60 provided on the hull 101 (the function as the overboard sensor) by way of example. The processor 61 of the communication unit 60 periodically transmits the query signal to all the fobs F corresponding to the registration IDs, and performs a process shown in FIG. 4 every time it transmits the query signal. The processor 61 determines whether or not response signals are received from all the fobs F (Step S1). If the response signals are received from all the fobs F (YES in Step S1), the processor 61 turns off overboard flags for all the fobs F (Step S2), and records in the memory 62 that none of the occupants carrying the fobs F are overboard. If no response signal is received from a specific one of the fobs F (NO in Step S1), the processor 61 determines whether the non-reception state of the specific fob F is observed consecutively a predetermined number of times (Step S3). If the non-reception state of the specific fob F is not observed consecutively the predetermined number of times (NO in Step S3), the processor 61 turns off all the overboard flags (Step S2). If the non-reception state of the specific fob F is observed consecutively the predetermined number of times (YES in Step S3), the processor 61 turns on an overboard flag for the specific fob F (Step S4), and records in the memory 62 that a person carrying the specific fob F is overboard. Further, the processor 61 transmits the overboard information to the watercraft maneuvering controller 50 (Step S5). As described above, the overboard information includes the registration ID of the specific fob F.

The reach range of the query signal to be transmitted to the fobs F by the communication unit 60 and the reach range of the response signal to be transmitted to the communication unit 60 by each of the fobs F are preferably set so that the communication unit 60 is able to communicate with the fobs F when the fobs F are present on the watercraft 100. Thus, the overboard flags for the fobs F present on the watercraft 100 are able to be turned off.

Figure 5:
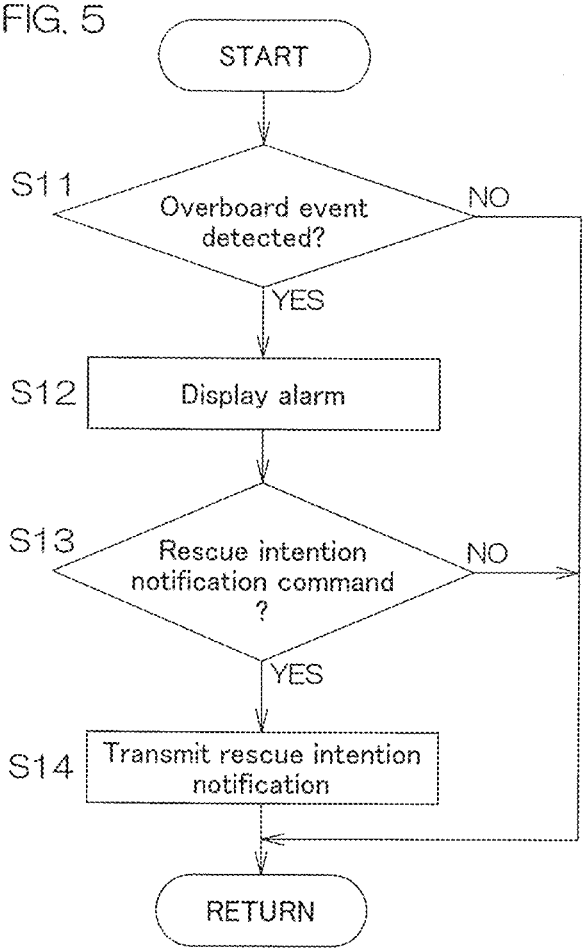
FIG. 5 is a flowchart showing an exemplary process to be performed by the watercraft maneuvering system for overboard detection.

FIG. 5 is a flowchart showing an exemplary process to be repeatedly performed in a predetermined control cycle in the watercraft maneuvering system 102 in relation to the overboard information. If the watercraft maneuvering controller 50 receives the overboard information from the communication unit 60 to detect the overboard event (YES in Step S11), the watercraft maneuvering controller 50 issues an alarm display command indicating the occurrence of the overboard event. This command is provided to the display 47 and/or the gauge 46, and an overboard alarm is displayed on the display 47 and/or the gauge 46 (Step S12).

The display of the alarm may include a query about the rescue intention notification. More specifically, the display of the alarm may include a message saying "Man overboard! Want to notify start of rescue to the person?" In addition to the alarm, reply buttons (e.g., a YES button and a NO button) operable to replay the query on the touch panels 47*a*, 46*a* are displayed on the display 47 and/or the gauge 46.

The watercraft maneuvering controller 50 determines whether or not the rescue intention notification command is inputted from the touch panel 47*a* as the input device of the display 47 or from the touch panel 46*a* as the input device of the gauge 46 (Step S13). Specifically, the watercraft maneuvering controller 50 checks whether or not the YES button is operated to replay the query. If the rescue intention notification command is inputted (YES in Step S13), the watercraft maneuvering controller 50 causes the communication unit 60 to transmit the rescue intention notification command to the fob F carried by the person who has fallen overboard. As described above, the transmission device 75 of the fob F receiving the rescue intention notification command provides the rescue intention notification to the overboard person.

In this process, the rescue intention notification is transmitted to the fob F of the overboard person through the control process performed by the watercraft maneuvering controller 50 by way of example. The control process may be performed in substantially the same manner by the processor of the communication unit 60 or the display 47.

In a preferred embodiment, as described above, the rescue intention notification is able to be transmitted from the communication unit 60 to the fob F carried by the overboard person when the overboard event occurs. Then, the fob F of the overboard person receives the rescue intention notification, and the transmission device 75 provides the rescue intention notification to the overboard person. Thus, the rescue intention notification is provided to the overboard person. Therefore, the overboard person is able to easily know the state of the rescue operation.

In a preferred embodiment, the rescue intention notification is transmitted from the communication unit 60 by operating the touch panel 46*a* as the input device of the gauge 46 and/or the touch panel 47*a* as the input device of the display 47. Therefore, the rescue intention notification is able to be transmitted to the fob F of the overboard person by operating the input devices provided on the watercraft 100. Thus, any of the occupants on the watercraft 100 is able to transmit the rescue intention notification to the overboard person. Therefore, the overboard person is able to know the state of the rescue operation.

In a preferred embodiment, the rescue intention notification is transmitted from the communication unit 60 toward the fob F of the overboard person by operating the rescue intention notification button 78 of any of the fobs F carried by the occupants onboard. Thus, the rescue intention notification is able to be provided to the overboard person by any of the occupants on the watercraft 100. Therefore, the overboard person is able to know the state of the rescue operation. In addition, any of the occupants on the watercraft 100 is able to promptly provide the rescue intention notification by operating the rescue intention notification button 78 provided as the input device on the fob F carried by himself.

In a preferred embodiment, the fobs F each include the microphone 76 and the speaker 77, and each have the speech communication function to transmit and receive the voice signals through the wireless communications with the communication unit 60 of the watercraft 100. Therefore, the person who has fallen overboard is able to perform speech communications with the use of the fob F such that the overboard person is able to easily check the state of the rescue operation and report his or her current situation through conversation.

The person who has fallen overboard is able to perform speech communications with the fob F of any of the occupants onboard by utilizing the speech communication function of the fobs F. The overboard person is able to perform speech communications with the display 47 (an example of the fixed speech communication device) provided on the watercraft 100 by utilizing the speech communication function of the fob F. Further, the overboard person is able to perform speech communications with the mobile phone M by utilizing the speech communication function of the fob F. Therefore, the overboard person is able to easily check the state of the rescue operation, and is able to report his or her current situation through conversation. The speech communications with any mobile phone may be utilized, so that the speech communication partner is not limited to the occupants on the watercraft 100. Therefore, the overboard person is able to more easily check the state of the rescue operation.

While preferred embodiments of the present invention have thus been described above, the present invention may be embodied in some other ways as will be described below by way of example.

In a preferred embodiment described above, the outboard motors 1 each including the engine as a prime mover are used as the propulsion systems, but propulsion systems of different structure may be used. For example, electric propulsion systems each including an electric motor as the prime mover may be used as the propulsion systems. Besides the outboard motors 1, the propulsion systems may be inboard motors, inboard/outboard motors, jet propulsion systems, or any other propulsion systems. In the electric propulsion systems, the nullification of the propulsive forces is typically achieved by stopping the electric motors.

In a preferred embodiment described above, the two propulsion systems (two outboard motors 1) are provided on the stern 2 by way of example, but the number and the positions of the propulsion systems are not limited to those. Alternatively, a single propulsion system or three or more propulsion systems may be provided on the stern 2. Further, a bow thruster may be provided around the bow.

In a preferred embodiment described above, the occupant overboard event is detected by using the fob F which wirelessly communicates with the communication unit 60 provided on the watercraft 100. Alternatively, the occupant overboard event may be detected by using a lanyard cable which connects the occupant to a lanyard switch provided on the watercraft 100.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An overboard detection system comprising:

a fob to be carried by a user on a watercraft;

an overboard sensor to detect a user overboard event when the user carrying the fob falls overboard;

an input operable by an occupant on the watercraft other than the user; and a communicator on the watercraft to wirelessly communicate with the fob; wherein when a rescue intention notification command is inputted from the input, the communicator is operable to transmit a rescue intention notification data, other than voice signals, indicating a rescue intention to the fob carried by the user involved in the overboard event;

the fob includes a transmitter to provide the rescue intention notification to the overboard user upon reception of the rescue intention notification data; and the transmitter is operable to generate at least one of sound, light, or vibration, other than voice, to provide the rescue intention notification to the overboard user.

2. The overboard detection system according to claim 1, wherein the input is on the watercraft.

3. The overboard detection system according to claim 1, wherein the input is provided on a fob carried by the occupant on the watercraft other than the user.

4. The overboard detection system according to claim 1, wherein the fob includes a microphone and a speaker to provide a speech communication function to transmit and receive voice signals through wireless communications with the communicator.

5. The overboard detection system according to claim 4, wherein the communicator is operable to relay inter-fob speech communications between the fob and another fob carried by another user on the watercraft.

6. The overboard detection system according to claim 5, further comprising:

a fixed speech communicator on the watercraft and including a microphone and a speaker; wherein the communicator relays speech communications between the fixed speech communicator and the fob.

7. The overboard detection system according to claim 4, wherein the communicator is operable to transmit and receive voice signals through wireless communications with a mobile phone so as to relay fob/mobile phone speech communications between the fob and the mobile phone.

8. The overboard detection system according to claim 1, wherein the overboard sensor includes a periodic signal receiver to receive a periodic signal periodically generated by the fob, and to detect the user overboard event based on a reception state of the periodic signal received by the periodic signal receiver.

9. A watercraft comprising:

a hull; and the overboard detection system according to claim 1.

* * * * *